US007661558B2

(12) United States Patent
De Laforcade

(10) Patent No.: US 7,661,558 B2
(45) Date of Patent: Feb. 16, 2010

(54) SACHET INCLUDING AT LEAST TWO SEALED COMPARTMENTS

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 589 days.

(21) Appl. No.: 11/174,627

(22) Filed: Jul. 6, 2005

(65) Prior Publication Data

US 2006/0016829 A1 Jan. 26, 2006

Related U.S. Application Data

(60) Provisional application No. 60/601,608, filed on Aug. 16, 2004.

(30) Foreign Application Priority Data

Jul. 22, 2004 (FR) ..... 04 51626

(51) Int. Cl.
*B65D 35/22* (2006.01)
*B67D 5/60* (2006.01)
*A61K 8/18* (2006.01)

(52) U.S. Cl. ..... 222/94; 222/145.3; 220/9.3; 220/520; 132/209

(58) Field of Classification Search ..... 222/94, 222/145.3; 383/38; 220/9.2, 9.3, 507, 520; 132/202, 208, 209
See application file for complete search history.

(56) References Cited

U.S. PATENT DOCUMENTS

| | | | | |
|---|---|---|---|---|
| 3,173,602 | A * | 3/1965 | Clipner | 383/37 |
| 4,312,473 | A | 1/1982 | Hoeller | |
| 5,407,278 | A | 4/1995 | Beer | |
| 7,234,630 | B2 * | 6/2007 | Wang | 229/120.31 |
| 2003/0019883 | A1 * | 1/2003 | De Laforcade | 222/1 |

FOREIGN PATENT DOCUMENTS

| | | |
|---|---|---|
| EP | 1 270 444 A1 | 1/2003 |
| FR | 2 826 641 | 1/2003 |
| FR | 2 841 537 | 1/2004 |
| JP | A 10-129681 | 5/1998 |

* cited by examiner

*Primary Examiner*—Kevin P Shaver
*Assistant Examiner*—Melvin A Cartagena
(74) *Attorney, Agent, or Firm*—Oliff & Berridge, PLC

(57) ABSTRACT

A sachet may include at least two sealed compartments. The sachet may include first and second opposite main walls, a partition separating an inside of the sachet into two compartments, and first and second foldable side walls situated on respective sides of the partition.

25 Claims, 3 Drawing Sheets

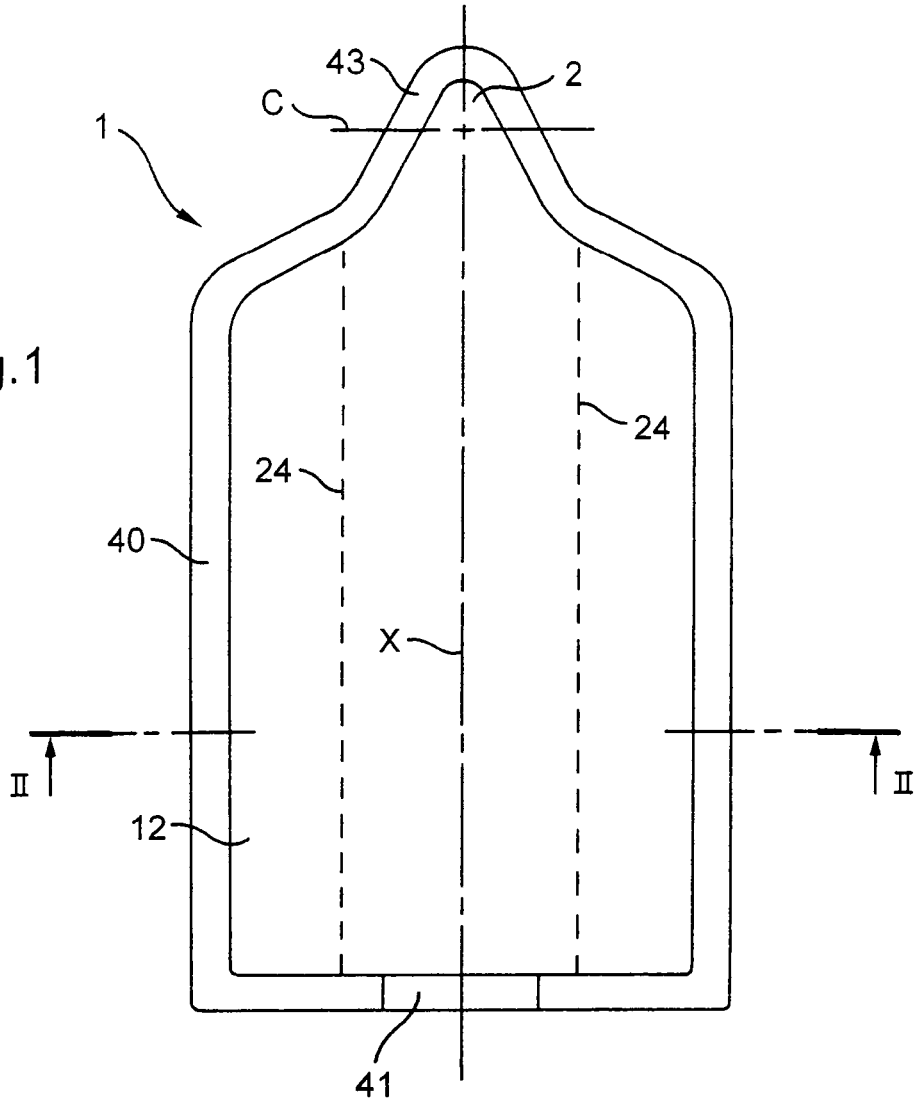
Fig.1
Fig.2
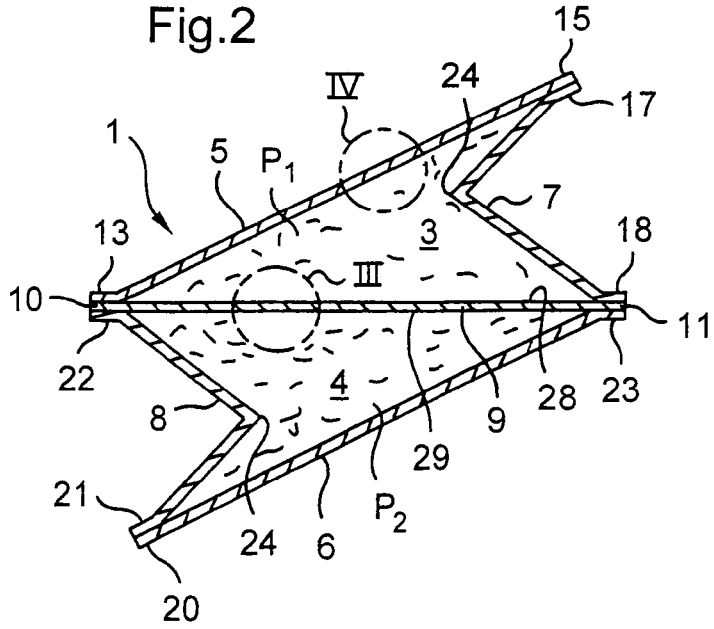
Fig.3
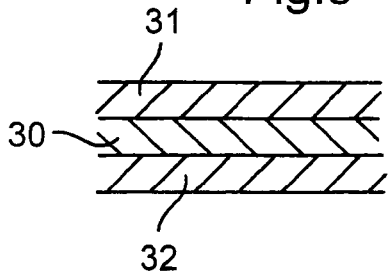
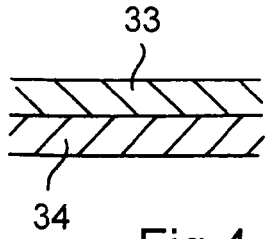
Fig.4

Fig.7
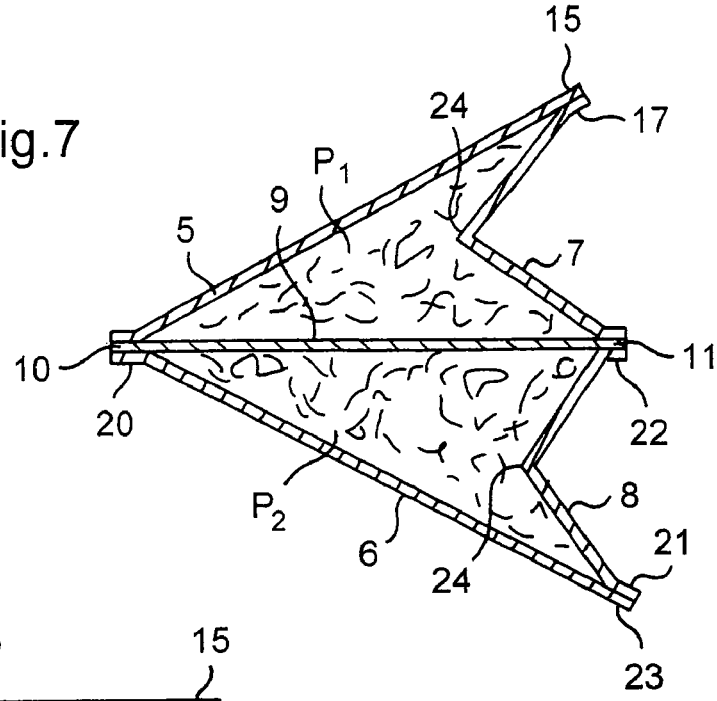
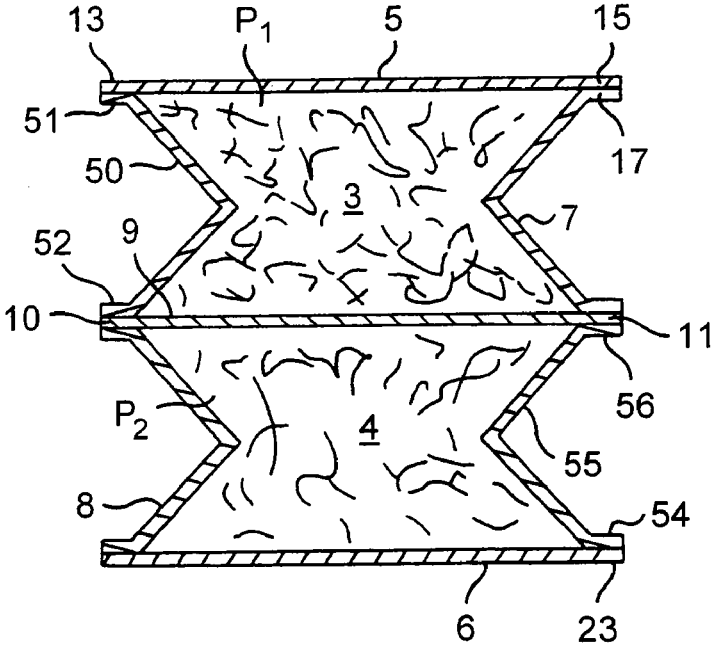
Fig.8
Fig.9
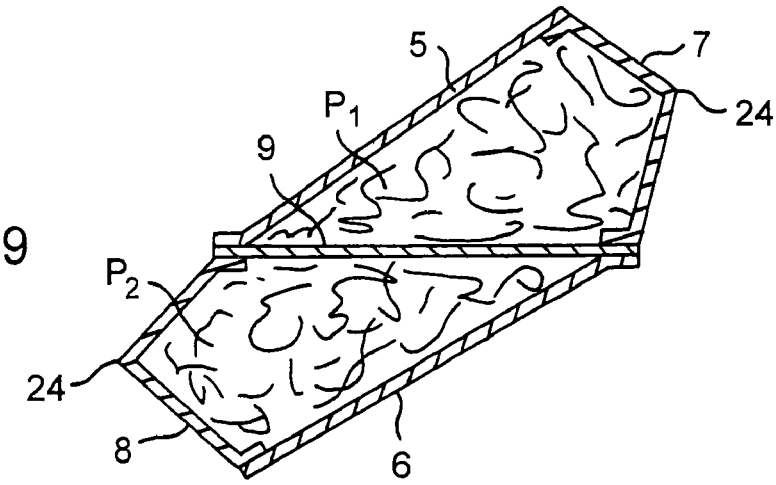

SACHET INCLUDING AT LEAST TWO SEALED COMPARTMENTS

CROSS-REFERENCE TO RELATED APPLICATIONS

This non-provisional application claims the benefit of French Application No. 04 51626 filed on Jul. 22, 2004 and U.S. Provisional Application No. 60/601,608 filed on Aug. 16, 2004, the entire disclosures of which are incorporated herein by reference.

BACKGROUND

The present invention relates to separate packaging of at least two substances, for example, substances that are to be mixed extemporaneously, for example, two hair coloring substances, such as a dye and a oxidizer.

Numerous two-compartment flasks have been proposed that enable two substances for mixing together extemporaneously to be packaged separately.

French patent application FR 2 826 641 discloses a device for simultaneously dispensing at least two substances packaged separately in first and second flexible-walled sachets. That device has first and second means for enabling the two sachets to be held stationary relative to each other in a superposed position so that their respective outlet orifices are disposed in a vicinity of each other. The second means are movable relative to the first means to exert pressure on both sachets so as to force their contents out through the orifices. Such a device is relatively complicated to implement.

SUMMARY

Nevertheless, known two-compartment flasks are relatively complex and expensive to manufacture. Also, a device such as described in FR 2 826 641 is relatively complicated to implement.

Exemplary embodiments of the invention seek to provide a solution to packaging at least two substances that is relatively simple, inexpensive, and/or practical to use.

Exemplary embodiments of the invention may provide a sachet including two sealed compartments, with first and second opposite main walls and with a partition separating an inside of the sachet into two compartments.

Exemplary embodiments of a dual sachet may enable two substances to be packaged in a manner that is relatively simple, reliable, and inexpensive.

Advantageously, in exemplary embodiments, the sachet may include first and second foldable side walls situated on respective sides of the partition. The first and second side walls may be, for example, situated opposite each other relative to a longitudinal axis of the partition. Such a disposition may facilitate filling. In exemplary embodiments, the first and second side walls may be situated on a same side relative to a longitudinal axis of the partition.

In exemplary embodiments, foldable side walls may enable a capacity of the sachet to be increased without increasing an area of the main walls, thereby making the sachet more ergonomic.

In exemplary embodiments, the first and second foldable side walls may be reentrant. In other exemplary embodiments, the first and second foldable side walls may project outwardly.

In exemplary embodiments, for at least a fraction of a length of the sachet: the first main wall may be connected to a first longitudinal edge of the partition; the second main wall may be connected to a second longitudinal edge of the partition, said second edge being opposite to the first; and the first side wall may connect the first main wall to the second longitudinal edge of the partition, and the second side wall may connect the second main wall to the first longitudinal edge of the partition.

In exemplary embodiments, at least one of the side walls may be folded along a fold line, which may be substantially parallel to the longitudinal axis of the partition.

In exemplary embodiments, the sachet may include a third foldable side wall disposed on a same side of the partition as the first side wall, each of the first and third side walls being connected firstly to the partition and secondly to the first main wall.

In exemplary embodiments, the sachet may include a fourth foldable side wall disposed on a same side of the partition as the second side wall, each of the second and fourth side walls being connected firstly to the partition and secondly to the second main wall.

In exemplary embodiments, the first and fourth side walls may be connected to a same longitudinal edge of the partition. In exemplary embodiments, the second and third side walls may be connected to a same longitudinal edge of the partition.

In exemplary embodiments, the sachet may be substantially symmetrical in structure about a longitudinal axis thereof.

In exemplary embodiments, the sachet may include a dispenser endpiece, which may be formed by assembling together and cutting out the main walls, the partition, and the side walls.

In exemplary embodiments, the fold line(s) may extend over at least a fraction of a length of the endpiece.

Thus, in exemplary embodiments, the first and second side walls may be folded along fold lines, which may extend over at least a fraction of the length of the endpiece. For example, the fold lines may extend over more than half of the length of the endpiece.

In exemplary embodiments, the partition may have different materials on opposite faces thereof. For example, the partition may have a material on one face adapted to withstand prolonged contact with a hair dye, and, on an opposite face, a material adapted to withstand prolonged contact with a hair oxidizer.

In exemplary embodiments, the main walls and the partition may be assembled together by heat sealing.

Similarly, in exemplary embodiments, the side walls and the partition may be assembled together by heat sealing.

In exemplary embodiments, at least one of the side walls may be made integrally, i.e., monolithically, with a main wall.

In exemplary embodiments, capacities of the two compartments may be substantially equal. The capacity of each compartment may, for example, be less than or equal to about 40 milliliters (mL).

In exemplary embodiments, at least the first and second main walls may comprise flexible sheets of composite structure, for example, comprising a film of metal, for example, aluminum, and at least one film of a thermoplastic material.

Exemplary embodiments of the invention may provide a method of coloring hair in which two substances contained respectively in the two compartments of a sachet as defined above are applied to the hair, the two substances being mixed together extemporaneously, for example.

Exemplary embodiments of the invention may provide a method of fabricating a sachet as defined above, in which flexible sheets for forming the two main walls, the partition, and the foldable side walls are superposed, with the sheets that are to form the side walls each being folded along at least one fold line, and in which the sheets as superposed in this way are heat sealed in a configuration corresponding to the sachet that is to be made.

In exemplary embodiments, the heat sealing may be performed in such a manner as to leave an opening for filling purposes on a side opposite from a dispenser endpiece. In exemplary embodiments, the main walls may be spaced apart prior to filling, and the opening that was used for filling may be heat sealed once the sachet has been filled.

BRIEF DESCRIPTION OF THE DRAWINGS

The invention may be better understood on reading the following detailed description of non-limiting embodiments thereof, and on examining the accompanying drawings, in which:

FIG. 1 is a face view of an exemplary sachet;

FIG. 2 is a diagrammatic and fragmentary cross sectional view of the sachet of FIG. 1, taken along II-II;

FIGS. 3 and 4 are diagrammatic views, respectively showing details III and IV of FIG. 2;

FIGS. 6 to 9 are views analogous to FIG. 2 showing other exemplary embodiments.

DETAILED DESCRIPTION OF EMBODIMENTS

Figure 5:
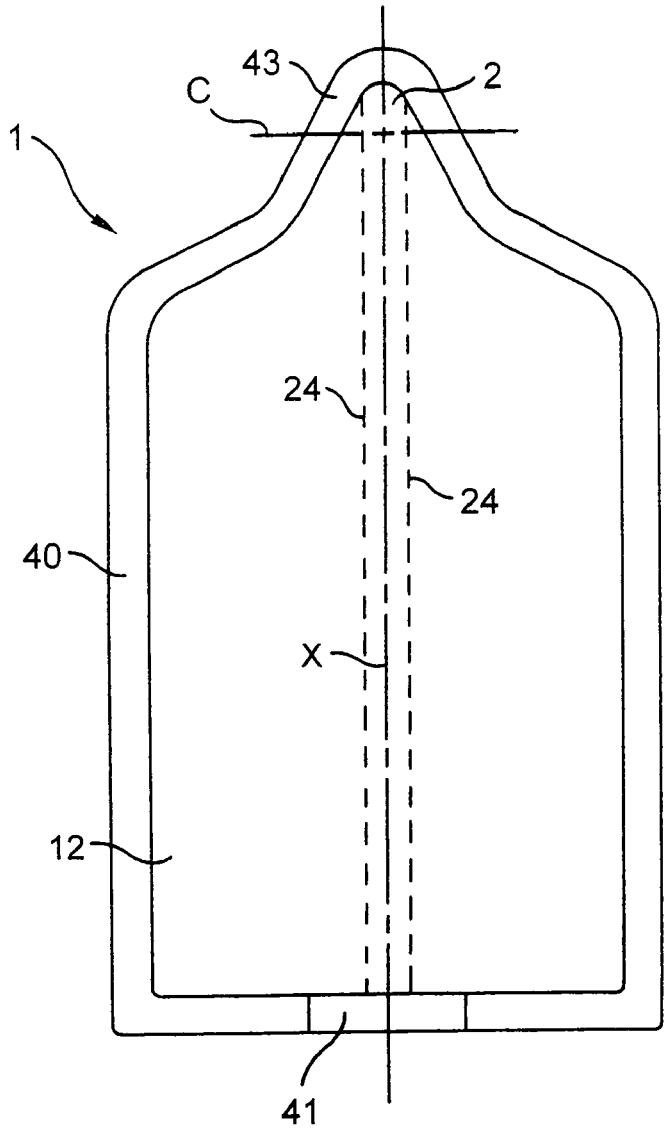
FIG. 5 is a view analogous to FIG. 1 showing another exemplary embodiment.

In the figures, and in particular in FIGS. 3 and 4, various elements are not necessarily shown in compliance with their real proportions, for the sake of clarity in the drawings.

An exemplary dual sachet 1 shown in FIGS. 1 and 2 may be generally elongate in shape along a longitudinal axis X. The sachet may include a body 12 that is extended at one end by a dispenser endpiece 2 that may be cut off in use along a line C, for example, to enable a user to empty contents from the sachet 1.

In the exemplary embodiment shown, the body 12 may be of substantially constant width, but may be otherwise without thereby going beyond the ambit of the present invention. For example, the body 12 may have a shape that is trapezoidal or oval.

The sachet 1 may define a first compartment 3 and a second compartment 4 for containing respective first and second substances $P_1$ and $P_2$ to be stored separately, and to be mixed together extemporaneously, for example.

One of the substances may comprise a dye and the other substance may comprise an oxidizer, for example, for coloring hair.

The sachet 1 may be given a variety of shapes and may have a variety of capacities. For example, the capacity of the sachet 1 may lie in a range from about 1 mL to about 40 mL per compartment, or even in a range from about 1 mL to about 80 mL, or even more, for example, as much as about 1 liter (L).

Where appropriate or desired, the dual sachet 1 may serve to test coloring on a lock of hair. In such a case, each compartment may have a capacity of about 1 mL, for example.

The sachet 1 may include first and second main walls 5 and 6, first and second foldable side walls 7 and 8, and an internal partition subdividing an inside of the sachet 1 into compartments 3 and 4.

The partition 9 may include first and second longitudinal edges 10 and 11 situated opposite each other, and first and second faces 28 and 29 situated respectively beside the first and second compartments 3 and 4.

The first main wall 5 may include a first longitudinal edge 13 that may be assembled, as shown in FIG. 2, to the first longitudinal edge 10 of the partition 9 on a same side as the first face 28, and a second longitudinal edge 15 that may be assembled to a first edge 17 of the first side wall 7, an edge 18 opposite thereto likewise being assembled to the second longitudinal edge 11 of the partition 9 on the same side as the first face 28.

Still in the exemplary embodiment shown in FIG. 2, the second main wall 6 may include a first longitudinal edge 20 that may be assembled to an edge 21 of the second side wall 8, an edge 22 opposite therefrom being connected to the first longitudinal edge 10 of the partition 9 on a same side as the second face 29, and a second longitudinal edge 23 that may be likewise assembled to the second longitudinal edge 11 of the partition 9, on the same side as the second face 29.

Each side wall 7 or 8 may be folded along a fold line 24 that may be substantially parallel to the longitudinal axis X, in the exemplary embodiment shown, and that may be situated at substantially equal distances from the edges 17 and 18, or 21 and 22.

In the exemplary embodiment shown, the sachet 1 may comprise a structure that is generally symmetrical relative to the axis X, at least over a fraction of a length thereof, as shown in FIG. 2. This need not necessarily be the case. It is possible, for example, for the side walls 7 and 8 to be unequal, for example, as a function of different respective capacities for the compartments 3 and 4.

When the sachet 1 is empty, the main walls 5 and 6 may be pressed against the partition 9, and the side walls 7 and 8 may be folded in half. When the sachet 1 is full, the side walls 7 and 8 may be deployed like a bellows.

To make the main walls 5 and 6, the side walls 7 and 8, and the partition 9, it is possible to use flexible sheets, each comprising a multilayer structure, as a function, for example, of a nature of the substances to be contained inside the sachet 1.

For example, the sheets used may comprise a film of polyethylene, a film of polyamide, a film of an appropriate varnish, a layer of aluminum, and/or superpositions of various materials. For example, the sheets used may comprise a composite structure including a layer of adhesive between a polyethylene film and a layer of aluminum.

The sheets used for making the various walls and the partition may preferably be selected so as to enable the walls and the partition to be assembled together by heat sealing, i.e., by localized application of heat.

For example, it is possible to use sheets with physicochemical properties that are different when constituting firstly the first main wall 5 and the first side wall 7, and secondly the second main wall 6 and the second side wall 8.

Similarly, the partition 9 may include different materials on the opposite faces 28 and 29 thereof.

For example, the partition 9 may comprise a sheet comprising two films that have been laminated together, for example, constituted by materials that are suitable for coming into contact respectively with the substances contained in each of the compartments 3 and 4.

The partition 9 may also have a composite structure as shown in FIG. 3, comprising an intermediate support film 34 coated on each face thereof with films 31 and 32 that may be adapted to packaging the substances 3 and 4.

Each main wall 5 or 6 or side wall 7 or 8 may comprise a composite structure as shown in FIG. 4, comprising an outer film 33 and an inner film 34 of a material that is suitable for coming into contact with the substance contained in the associated compartment.

The outer film 33, like the intermediate film 30 of the partition 9, may comprise, for example, a layer of aluminum, and one of the covering films 31, 32, or 34 may comprise a thermoplastic material.

To fabricate the sachet 1, it is possible, for example, to start from five sheet elements packaged on respective reels. The sheets may be superposed, with the sheets that are to form the side walls 7 and 8 being delivered in a folded state to a heat sealing station.

The endpiece 2 may be situated between fold lines 24 when the sachet 1 is empty and flat. The main walls 5 and 6 may be assembled respectively to the faces 28 and 29 of the partition 9 around a periphery 43 of the endpiece 2.

The sachet 1 may also be heat sealed to a periphery 40 of the body 12 with the exception of a zone 41 situated on an edge opposite from the endpiece 2, between the fold lines 24 and at a distance therefrom, said zone 41 being shown outlined in dashed lines in FIG. 1.

On reaching a filler station, the main walls 5 and 6 may be spread apart from each other, for example, by suction cups, and feed pipes may be inserted into the compartments 3 and 4 to fill the compartments 3 and 4.

After filling, the zone 41 may be closed by heat sealing so as to package the two substances $P_1$ and $P_2$ in a sealed manner in the compartments 3 and 4.

In use, a user may cut off the endpiece 2 so as to release the two dispenser orifices opening respectively into the compartments 3 and 4 and separated by the partition 9.

To dispense the contents of the sachet 1, the user may press on the main walls 5 and 6 so as to move them toward each other. The substances $P_1$ and $P_2$ contained in the compartments 3 and 4 may be mixed directly on the hair. Alternatively or additionally, the substances may be mixed in an auxiliary receptacle, prior to being applied to the hair.

Naturally, the invention is not limited to the exemplary embodiments described above.

In another exemplary embodiment shown in FIG. 5, the fold lines 24 may be close enough to the longitudinal axis X to extend over a fraction of a length of the endpiece 2, for example, over more than half of the length thereof, as shown.

Thus, when the endpiece 2 is cut along line C, the dispenser orifice may enlarge by deployment of the side walls 7 and 8, thereby reducing head loss and facilitating flow of the substances $P_1$ and $P_2$ out of the sachet 1.

Figure 6:
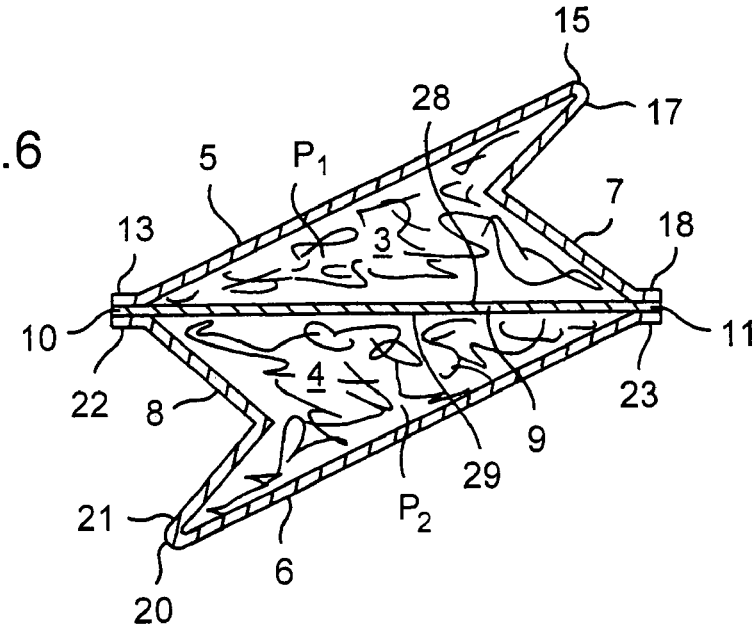

FIG. 6 shows the possibility of making the main walls 5 and 6 integrally, i.e., monolithically, with the side walls 7 and 8, respectively.

FIG. 7 shows the possibility of including side walls 7 and 8 that connect to a same longitudinal edge 11 of the partition 9. The second main wall 6 may thus be connected via the edge 20 thereof to the longitudinal edge 10 of the partition 9 and via the edge 23 thereof to the edge 21 of the foldable side wall 8, the edge 22 of the side wall 8 being connected to the longitudinal edge 11 of the partition 9.

FIG. 8 shows the possibility of the sachet including more than two foldable side walls, for example, four foldable side walls disposed in pairs on either side of the partition 9. In such embodiments, compartments 3 and 4 may each constitute a bellows.

The first main wall 5 may be connected, for example, to a third foldable side wall 50 via the edge 13 thereof. The third foldable side wall 50 may include an edge 51 that may be connected to the first main wall 5 and an opposite edge 52 that may be connected to the longitudinal edge 10 of the partition 9. The second main wall 6 may be connected via the edge 23 thereof to the edge 54 of a fourth foldable side wall 55, which may in turn be connected to the longitudinal edge 11 of the partition 9 via an edge 56 thereof opposite to the edge 54.

In the exemplary embodiment shown, the sachet 1 may be generally symmetrical in structure about the longitudinal axis X, but that need not be so. For example, the first and third side walls 7 and 50 may have dimensions that are different from the second and fourth side walls 8 and 55, particularly if the compartments 3 and 4 are to have different capacities.

FIG. 9 shows the possibility of the foldable side walls 7 and 8 having shapes that project outward rather than inward.

The characteristics of the various exemplary embodiments described above may be combined.

For example, in the exemplary embodiment shown in FIG. 7, the main wall 5 and the side wall 7 may be made as a single piece, as may the main wall 6 and the side wall 8. The same may apply to the exemplary embodiments of FIGS. 8 and 9.

In the exemplary embodiment shown in FIG. 7, the side walls may project outward rather than inward. The same may apply to the exemplary embodiment of FIG. 8.

Where appropriate or desired, the partition 9 may comprise two sheets placed side by side, at least in part, for example, along edges thereof.

Sachets may be packaged in various ways, for example, as a string or individually. When the package includes a string, the sachets may be assembled to one another either sideways or lengthwise. When are assembled together lengthwise, a bottom of one sachet may have a shape corresponding to the endpiece of the following sachet.

Throughout the description, including in the claims, the terms "comprising a" and "including a" should be understood as being synonymous with "comprising at least one" and "including at least one," unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A sachet having at least two sealed compartments containing fluids and comprising:

first and second opposite main walls;

a partition wall, in direct contact with the respective fluids, separating the inside of the sachet into the two compartments, said partition wall having two opposite faces each facing one of the two compartments; and a first folded side wall having a first fastening surface and a second folded side wall having a second fastening surface, the first and second fastening surfaces being fastened to respective opposite faces of the partition wall, each of the first fastening surface and the second fastening surface forming a heat seal with the respective opposite face of the partition wall, the first folded side wall being fastened to the first main wall and the second folded side wall being fastened to the second main wall.

2. A sachet according to claim 1, wherein the first and second folded side walls are reentrant.

3. A sachet according to claim 1, wherein the first and second folded side walls project outwards.

4. A sachet according to claim 1, wherein the first and second side walls are situated substantially opposite each other about a longitudinal axis of the partition wall.

5. A sachet according to claim 4, wherein, for at least a fraction of the length of the sachet:

the first main wall is connected to a first longitudinal edge of the partition wall;

the second main wall is connected to a second longitudinal edge of the partition wall, said second edge being opposite the first edge; and the first side wall connects the first main wall to the second longitudinal edge of the partition wall and the second side wall connects the second main wall to the first longitudinal edge of the partition wall.

6. A sachet according to claim 1, wherein the first and second side walls are both situated on a common side relative to a plane containing the longitudinal axis of the partition wall.

7. A sachet according to claim 1, wherein at least one of the side walls is folded along a fold line.

8. A sachet according to claim 7, wherein the fold line is substantially parallel to a longitudinal axis of the partition wall.

9. A sachet according to claim 7, including a dispenser endpiece, and wherein the fold line extends over at least a fraction of the length of the endpiece.

10. A sachet according to claim 9, wherein the first and second side walls are folded along fold lines, and wherein said fold lines extend over at least a fraction of the length of the endpiece.

11. A sachet according to claim 10, wherein the fold lines extend over more than half the length of the endpiece.

12. A sachet according to claim 1, the sachet being symmetrical in structure about its longitudinal axis.

13. A sachet according to claim 1, including a dispenser endpiece comprising two dispenser orifices opening respectively into the compartments and separated by the partition wall.

14. A sachet according to claim 1, wherein the partition wall comprises different materials on its opposite faces.

15. A sachet according to claim 1, wherein the two compartments present capacities that are substantially equal.

16. A sachet according to claim 1, wherein the capacity of each compartment is less than or equal to 40 mL.

17. A sachet according to claim 1, wherein the first and second main walls are formed at least by flexible sheets of composite structure.

18. A sachet according to claim 1, including a third folded side wall disposed on the same side of the partition wall as the first side wall, the first and third side walls each being connected firstly to the partition wall and secondly to the first main wall.

19. A sachet according to claim 18, including a fourth folded side wall disposed on the same side of the partition wall as the second side wall, the second and fourth side walls being each connected firstly to the partition wall and secondly to the second main wall.

20. A sachet according to claim 19, wherein the first and fourth side walls are connected to a common longitudinal side of the partition wall.

21. A sachet according to claim 18, wherein the second and third side walls are connected to a common longitudinal side of the partition wall.

22. A sachet according to claim 1, wherein the partition wall is non-foldable.

23. A method of coloring hair comprising:

applying to hair two substances contained respectively in two compartments of a sachet, said sachet having:

first and second opposite main walls;

a partition wall, in direct contact with the respective substances, separating an inside of the sachet into the two compartments, said partition wall having two opposite faces each facing one of said two compartments; and a first folded side wall having a first fastening surface and a second folded side wall having a second fastening surface, the first and second fastening surfaces being fastened to respective opposite faces of the partition wall, each of the first fastening surface and the second fastening surface forming a heat seal with the respective opposite face of the partition wall, the first folded side wall being fastened to the first main wall and the second folded side wall being fastened to the second main wall, mixing the two substances together extemporaneously.

24. A method of fabricating a sachet having two sealed compartments containing fluids:

first and second opposite main walls;

a partition wall, in direct contact with the respective fluids, separating an inside of the sachet into two compartments, said partition wall having two opposite faces each facing one of said two compartments; and a first folded side wall having a first fastening surface and a second folded side wall having a second fastening surface, the first and second fastening surfaces being fastened to respective opposite faces of the partition wall, each of the first fastening surface and the second fastening surface forming a heat seal with the respective opposite face of the partition wall, the first folded side wall being fastened to the first main wall and the second folded side wall being fastened to the second main wall, the method comprising:

superposing flexible sheets for forming the two main walls, the partition wall, and the folded side walls;

folding each of the flexible sheets for forming the side walls along at least one fold line; and heat sealing the sheets, as superposed and folded, to one another in a configuration corresponding to said sachet.

25. A method according to claim 24, wherein the heat sealing is performed in such a manner as to leave the end opposite from a dispenser endpiece with an opening enabling filling to be performed, and wherein the main walls are spaced apart during filling, and the opening that is used for filling is closed by heat sealing once the sachet has been filled.

* * * * *